US011771201B1

(12) United States Patent
Liu

(10) Patent No.: US 11,771,201 B1
(45) Date of Patent: Oct. 3, 2023

(54) ENVIRONMENTALLY FRIENDLY LIPSTICK TUBE WITH A REPLACEABLE LIPSTICK

(71) Applicant: Zhuhai Ding Rong Plastic Products Co., LTD., Zhuhai (CN)

(72) Inventor: Ting Nan Liu, New Taipei (TW)

(73) Assignee: Zhuhai Ding Rong Plastic Products Co., LTD., Zhuhai (CN)

( * ) Notice: Subject to any disclaimer, the term of this patent is extended or adjusted under 35 U.S.C. 154(b) by 0 days.

(21) Appl. No.: 17/872,122

(22) Filed: Jul. 25, 2022

(51) Int. Cl.
*A45D 40/06* (2006.01)
*A45D 40/00* (2006.01)

(52) U.S. Cl.
CPC ..... *A45D 40/06* (2013.01); *A45D 2040/0031* (2013.01); *A45D 2040/0043* (2013.01)

(58) Field of Classification Search
CPC ..... A45D 40/04; A45D 40/14; A45D 40/16; A45D 2040/0043; A45D 2040/0031; A45D 2040/0037
USPC ..... 401/68, 75, 171–174
See application file for complete search history.

(56) References Cited

U.S. PATENT DOCUMENTS 5,399,040 A * 3/1995 Holloway ..... A45D 40/06 401/86
8,328,445 B2 * 12/2012 Martins ..... A45D 40/16 401/78
11,357,308 B1 * 6/2022 Liu ..... A45D 40/00

* cited by examiner

*Primary Examiner* — David J Walczak

(57) ABSTRACT

A lipstick tube includes a lipstick carrier partially disposed in a cap and including a rotational seat, an axial snapping hole, and a snapping member between the snapping hole and the rotational seat; a joining device including an axial well, an annular protrusion, an annular member including two opposite recesses having a recessed element at an end, and two opposite latches each including first, second and third cavities at an end, and a protuberance having an inclined surface urging against the snapping member; and a base including a central shaft, a positioning member at an end of the shaft, four locking elements at four corners of the positioning member respectively, the locking elements being in the second and third cavities respectively, two opposite first ribs on an inner surface of the base configured to moveably dispose in the recesses respectively, and two positioning elements in the recessed elements respectively.

10 Claims, 10 Drawing Sheets

ENVIRONMENTALLY FRIENDLY LIPSTICK TUBE WITH A REPLACEABLE LIPSTICK

FIELD OF THE INVENTION

The invention relates to lipstick tubes and more particularly to an environmentally friendly lipstick tube having a replaceable lipstick.

BACKGROUND OF THE INVENTION

Conventional lipstick tubes are intended to be thrown away after the lipstick has been consumed. However, this is not environment friendly and may harm the environment.

For overcoming the drawbacks, the present inventor has invented a lipstick tube having a replaceable lipstick. In detail, the lipstick tube comprises a cover, a lipstick carrier, a joining device, and a base. A snapping hole is provided at one end of the lipstick carrier. Two cavities are provided at two opposite portions of the snapping hole respectively. Two raised members are provided on an inner surface of the lipstick carrier and are away from the cavities. A shaft is provided on a bottom of the lipstick carrier. A flange is provided at either end of the shaft and extends radially. The flanges urge against the raised members respectively in a locked position. A rotation of the base can disengage the shaft from the lipstick carrier prior to replacing a consumed lipstick with a new one.

However, the flanges may wear after a period of time of use since they urge against the raised members. And in turn, it may loosen the lipstick carrier.

Thus, the need for improvement still exists.

SUMMARY OF THE INVENTION

It is therefore one object of the invention to provide a lipstick tube comprising a cap comprising an internal space; a lipstick carrier partially disposed in the space and comprising a rotational seat at a first end distal the cap, a snapping hole axially disposed in the rotational seat, and a curved snapping member disposed between the snapping hole and the rotational seat; a joining device comprising an axial well at a first end with the first end of the lipstick carrier disposed therein, an annular protrusion at the first end, an annular member extending out of the annular protrusion, the annular member including two opposite recesses, each recess having a recessed element at a first end, and two internal, opposite latches disposed in the axial well, each latch including a first cavity on an inner surface of an end, a second cavity spaced from a first end of the first cavity, a third cavity spaced from a second end of the first cavity, and a protuberance on an outer surface of the end of the latch aligned with the first cavity, the protuberance having an inclined surface extending downward, the inclined surfaces urging against the snapping member; and a base comprising a central shaft on a bottom, a positioning member at an end of the shaft, four locking elements at four corners of the positioning member respectively, the locking elements being disposed in the second cavities and the third cavities respectively, two opposite first ribs on an inner surface of the base configured to moveably dispose in the recesses respectively, and two positioning elements each formed with the first rib and disposed in the recessed element.

Preferably, each of the recesses include a shoulder at a second end opposite to the recessed element.

Preferably, the latches are spaced with a gap formed between the latches.

The invention has the following advantages and benefits in comparison with the conventional art:

Less wear and prolonged useful life. The inclined surfaces urge against the snapping member and when the base is rotated the latches may exert an elastic force to decrease wear of both the joining device and the lipstick carrier to a minimum. As such, the times of replacing a consumed lipstick with a new one in another lipstick carrier can be increased. As a result, a useful life of the lipstick tube can be greatly prolonged.

Easy lipstick replacement and environment friendly. For removing a consumed lipstick, firstly, a user may remove the cap out of the joining device to expose a consumed lipstick. Secondly, the user may hold the joining device and clockwise rotate the base 45 degrees so that the first ribs move in the recesses respectively, the positioning elements urge against the shoulders respectively, the positioning member also clockwise rotates 45 degrees, the locking elements move into the gap and the first cavities, and the latches are inward flexed to disengage the inclined surfaces from the snapping member. The lipstick carrier is unlocked. Finally, the user may lift the lipstick carrier to disengage it from both the joining device and the base. Only the consumed lipstick is replaced rather than discarding the lipstick tube. In other words, the lipstick tube of the invention is reusable and environment friendly and does not harm the environment.

Easy positioning. The locking elements move into the gap and the first cavities, and the latches are inward flexed to disengage the inclined surfaces from the snapping member in the unlocking process of the lipstick carrier. Further, the snapping member is annular to facilitate an installation of another lipstick carrier in the well without being limited by an angle of the installation.

The above and other objects, features and advantages of the invention will become apparent from the following detailed description taken with the accompanying drawings

DETAILED DESCRIPTION OF THE INVENTION

Figure 1:
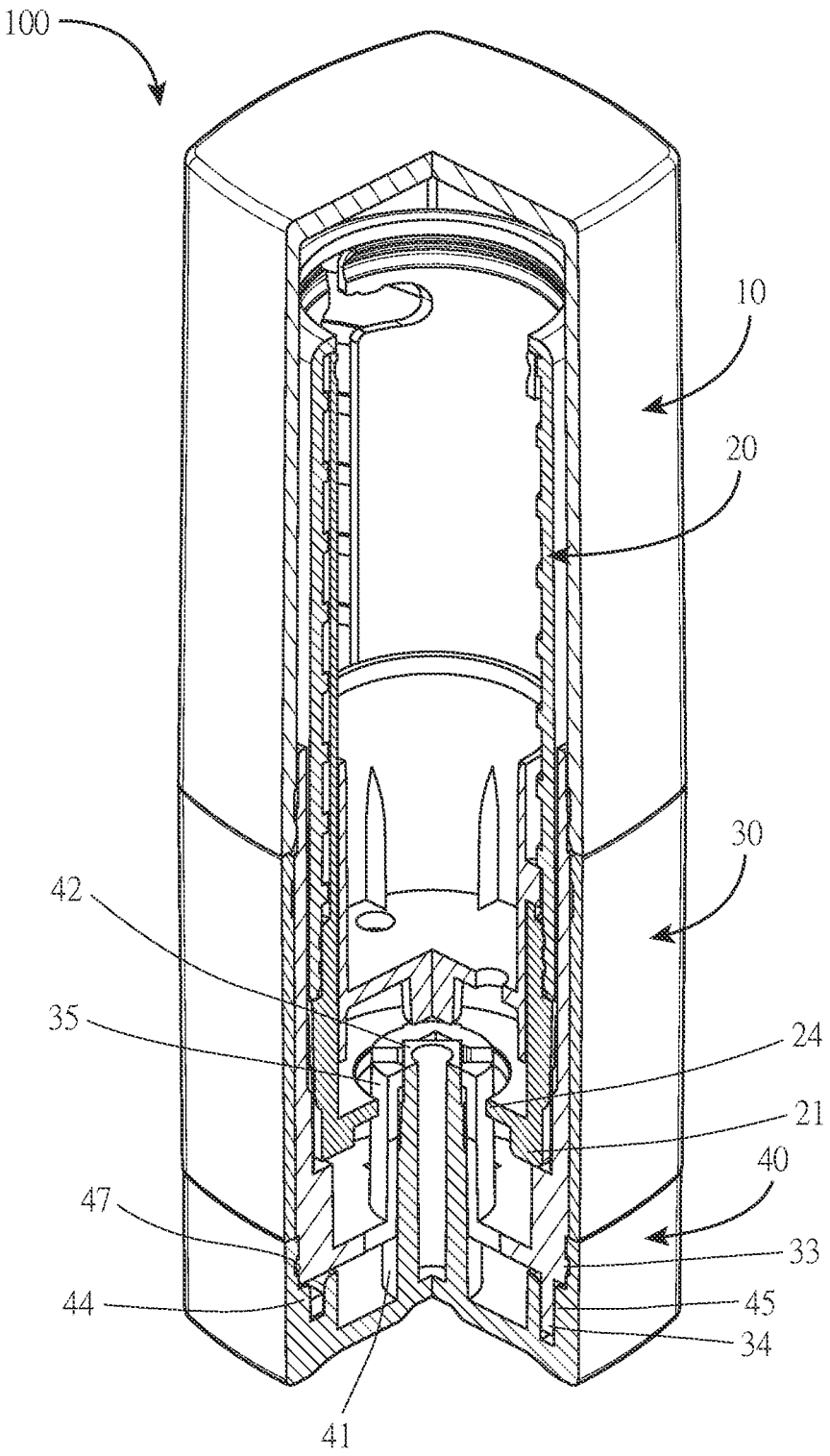
FIG. 1 is a longitudinal sectional view of a lipstick tube of the invention.
Figures 2, 3:
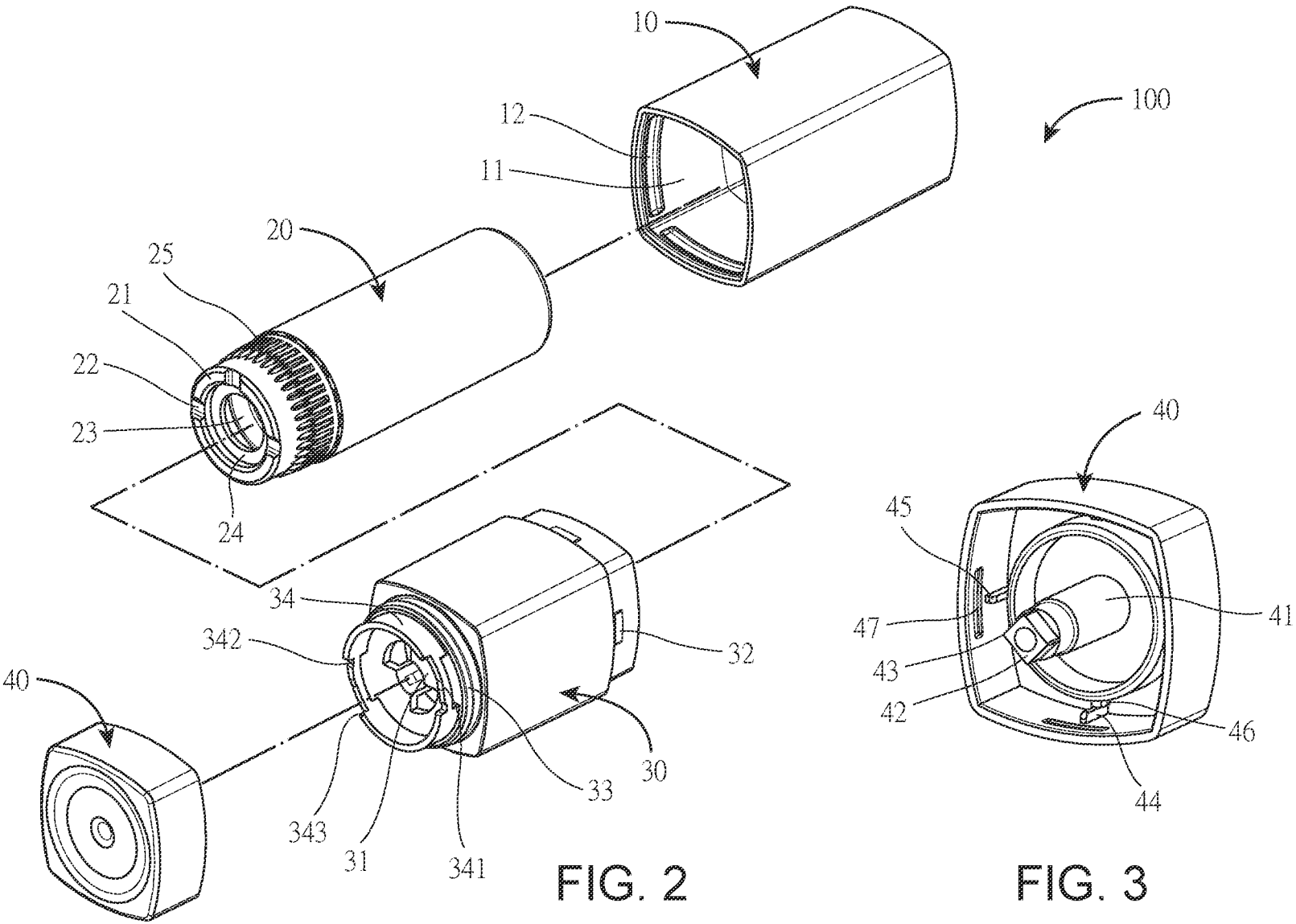
FIG. 2 is an exploded view of the lipstick tube.
FIG. 3 is a perspective view of the base.
Figure 4:
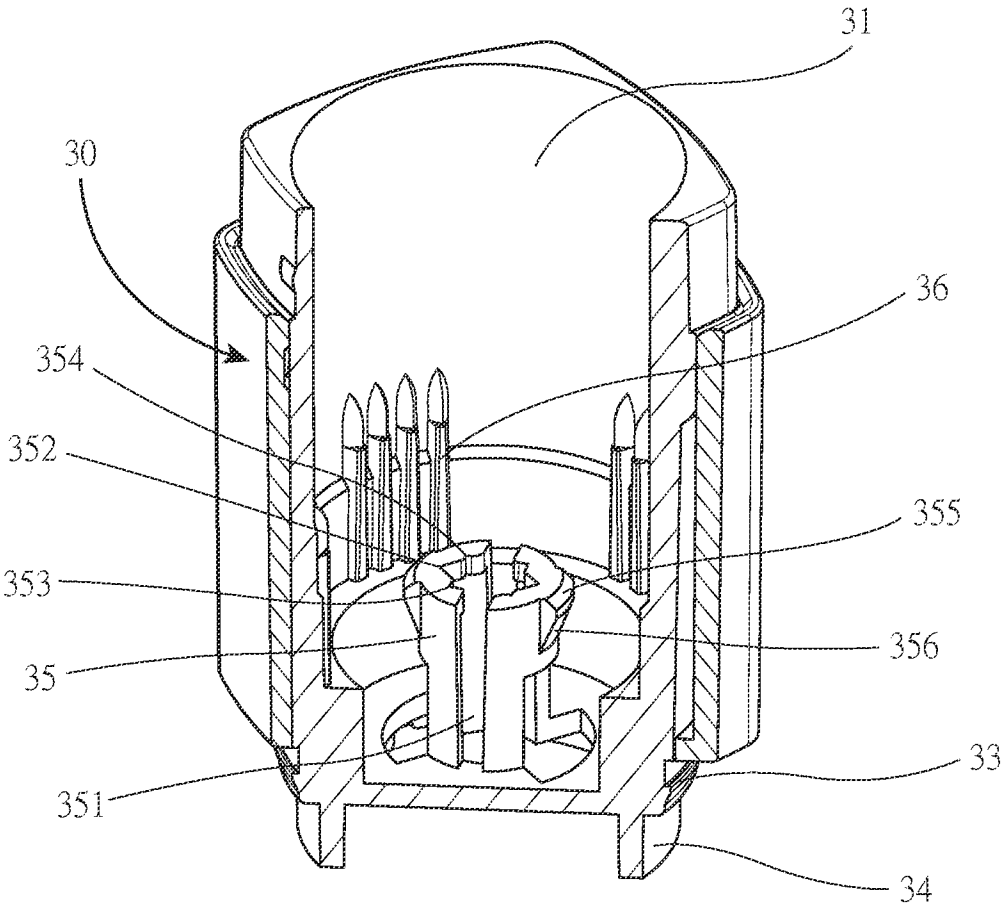
FIG. 4 is a longitudinal sectional view of the joining device.
Figure 5:
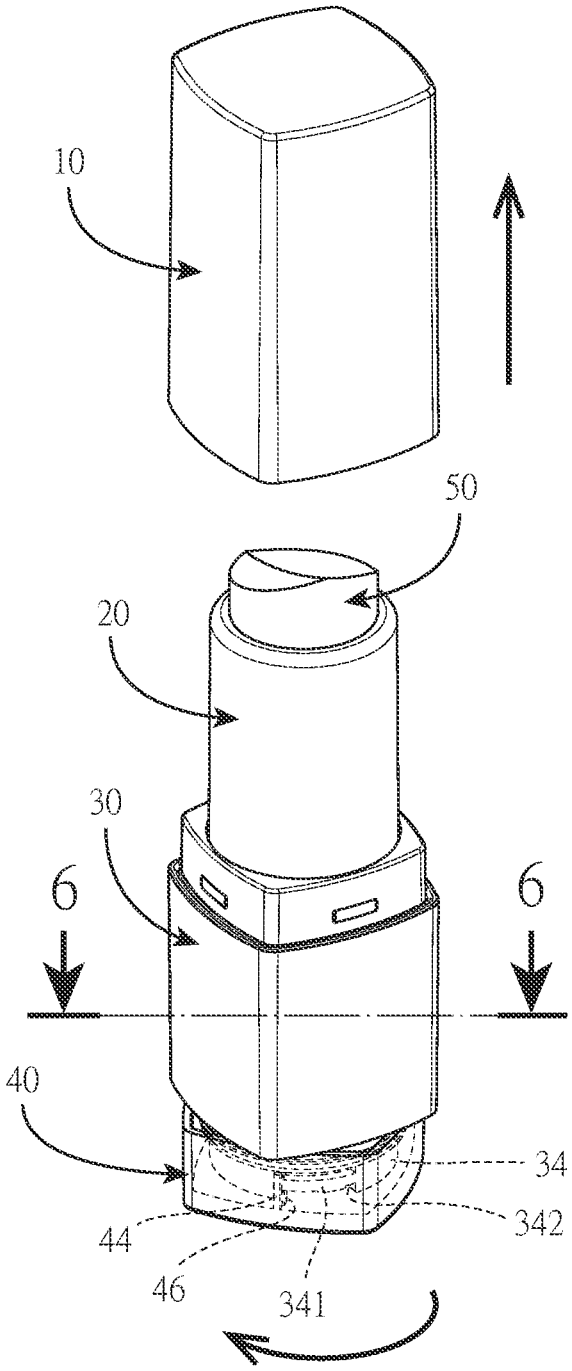
FIG. 5 is an exploded, perspective view showing the lipstick tube being open and the base being clockwise rotated.
Figure 6:
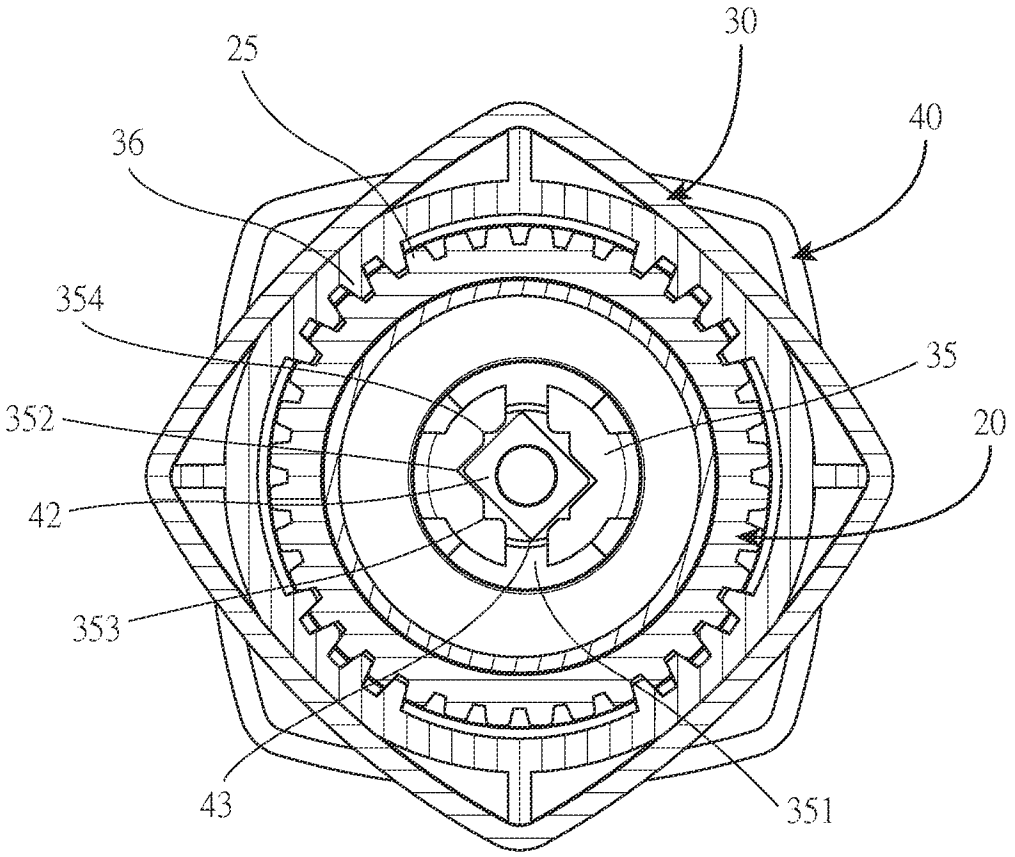
FIG. 6 is a sectional view taken along line 6-6 of FIG. 5.
Figure 8:
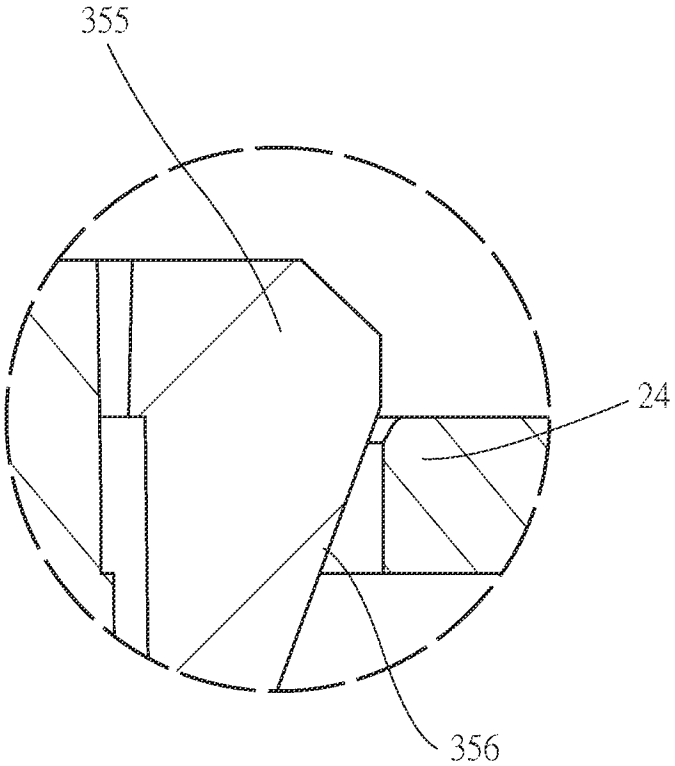
FIG. 8 is a detailed view of the area in circle A of FIG. 7.
Figure 7:
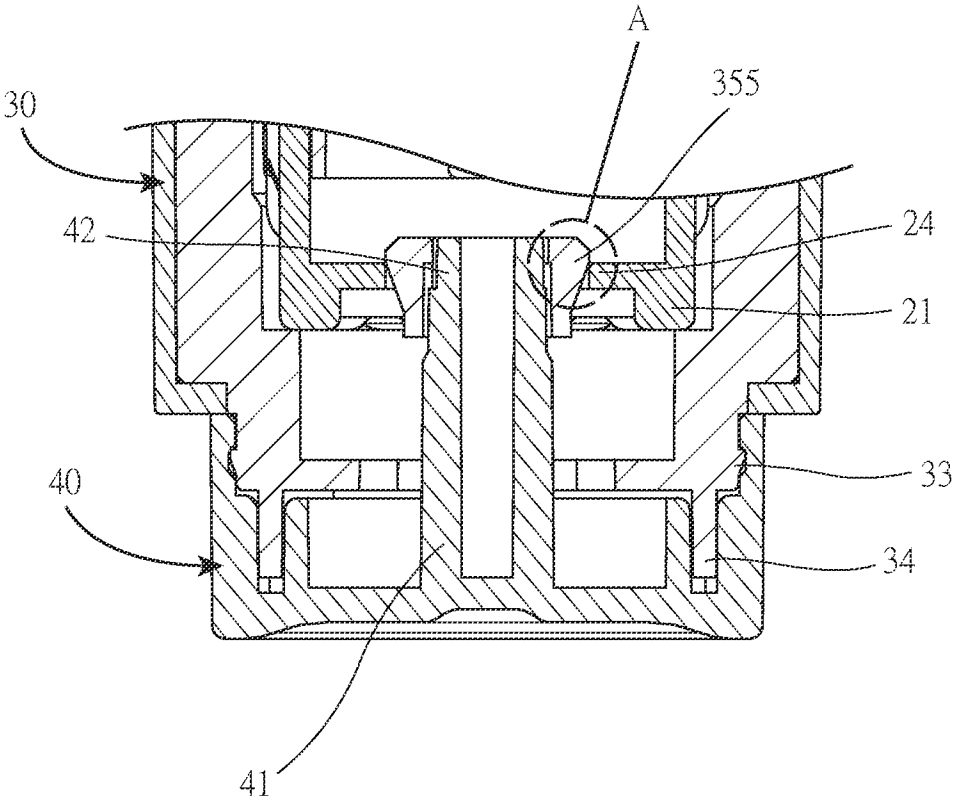
FIG. 7 is a partial sectional view showing the inclined surfaces disengaged from the snapping member.
Figure 9:
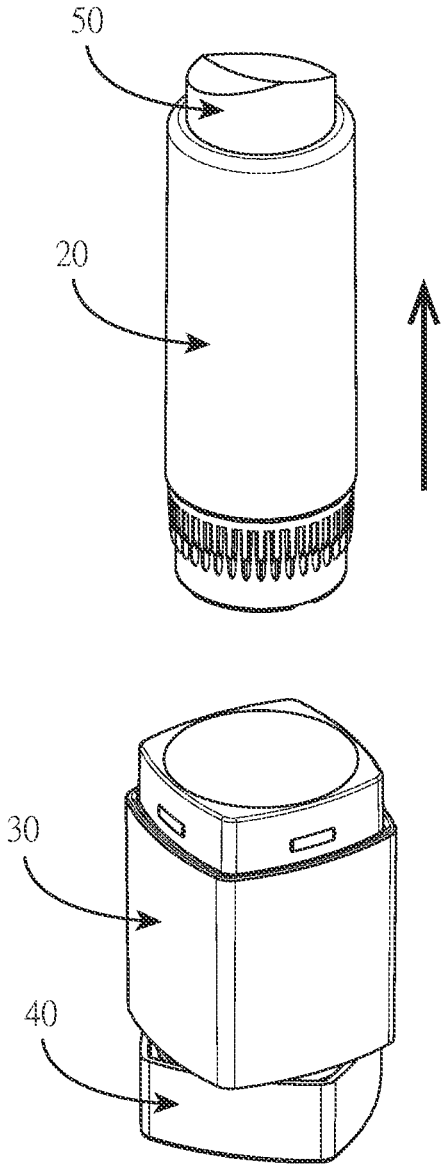
FIG. 9 schematically shows the lipstick carrier removed from both the joining device and the base by pulling upward.
Figure 10:
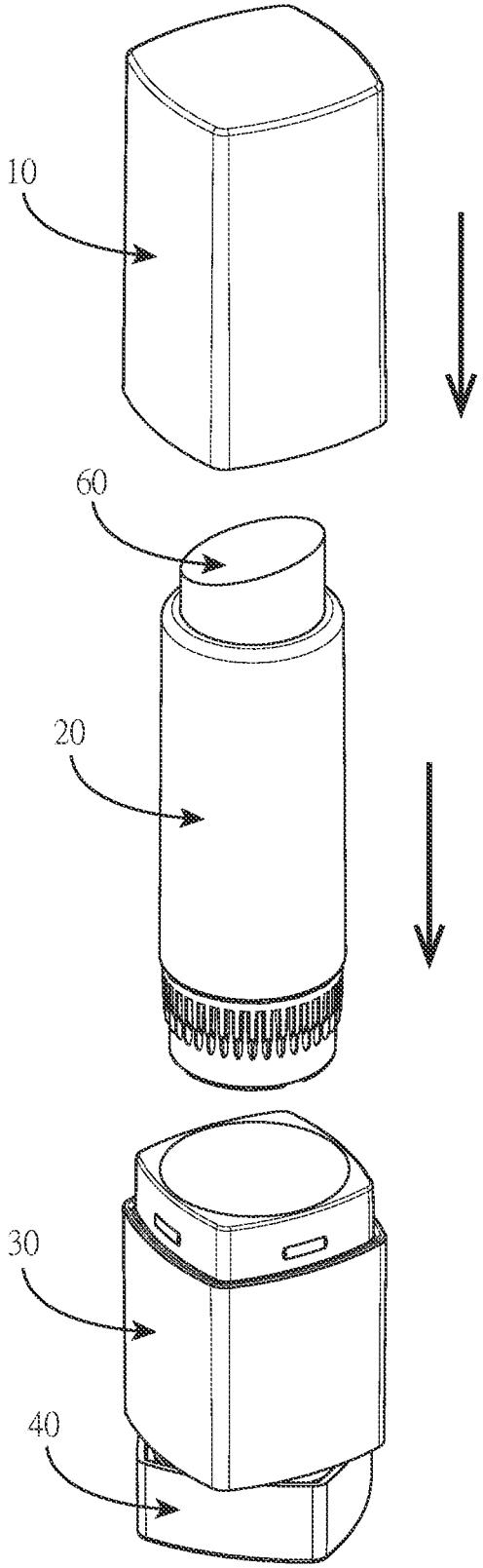
FIG. 10 schematically shows a consumed lipstick having been replaced by a new lipstick and to be fitted together with the joining device, the base and the cap.
Figure 11:
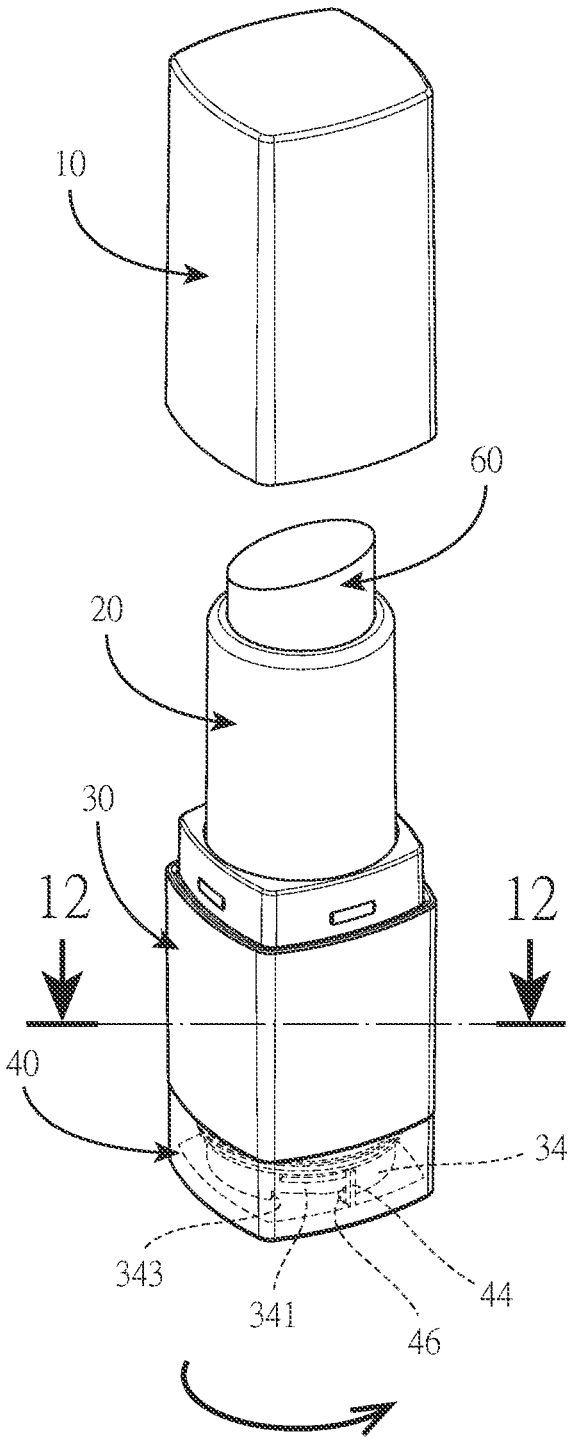
FIG. 11 is an exploded, perspective view showing the base being counterclockwise rotated after the consumed lipstick has been replaced the new lipstick.
Figure 12:
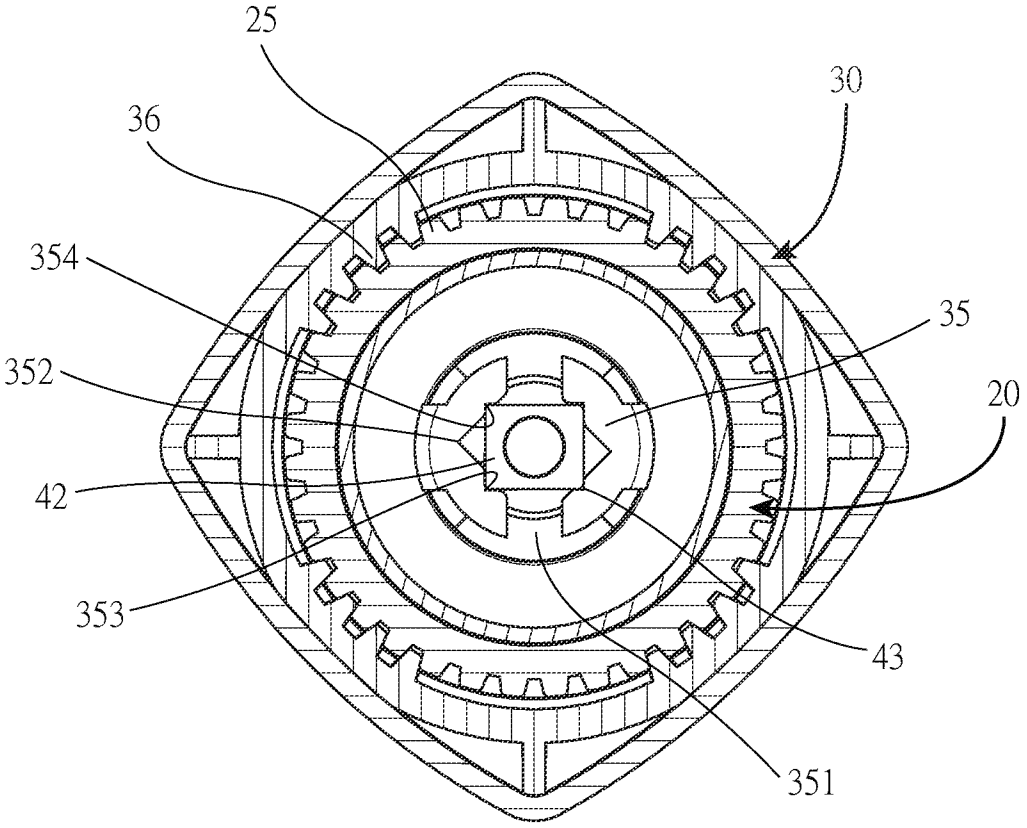
FIG. 12 is a sectional view taken along line 12-12 of FIG. 11.
Figure 14:
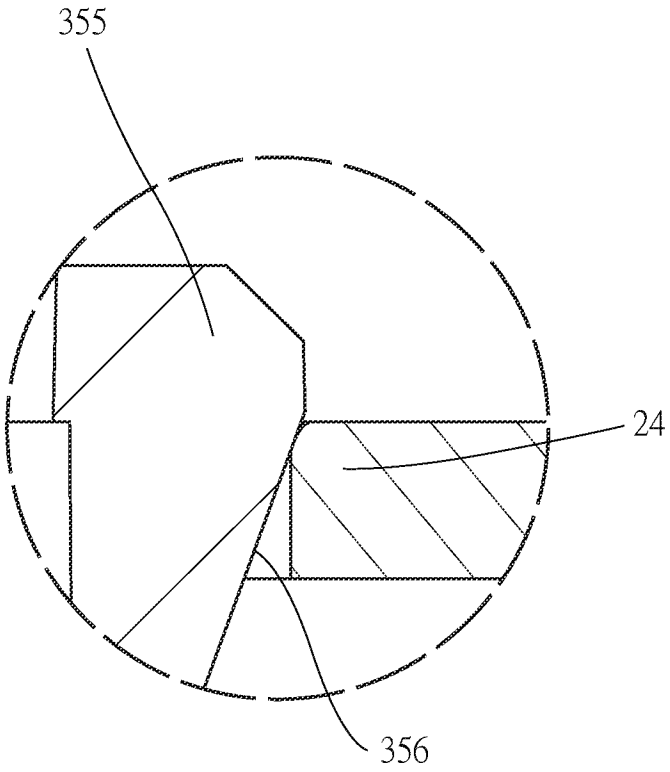
FIG. 14 is a detailed view of the area in circle A of FIG. 13.
Figure 13:
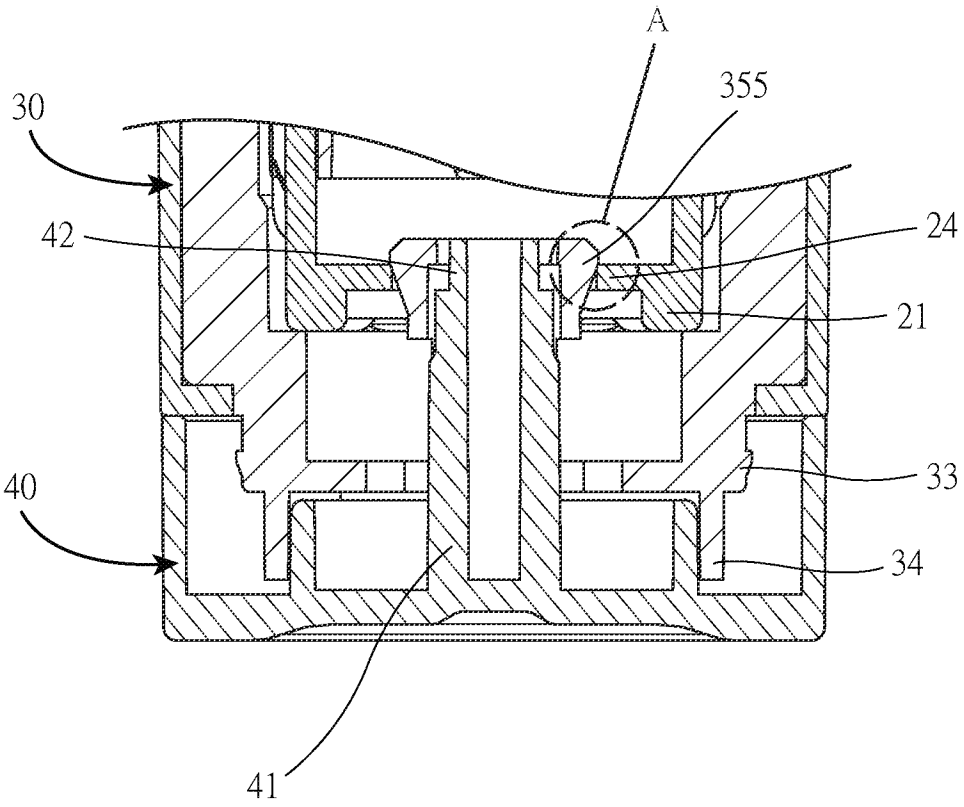
FIG. 13 is a partial sectional view showing the inclined surfaces urging against the snapping member.

Referring to FIGS. 1 to 14, a lipstick tube 100 in accordance with the invention comprises the following components as discussed in detail below.

A cap 10 includes an internal space 11 and a plurality of grooves 12 on an inner surface adjacent to its opening.

A cylindrical lipstick carrier 20 is partially disposed in the space 11 and includes a rotational seat 21 at a first end distal the cap 10, a plurality of cuts 22 at an edge of the rotational seat 21, a snapping hole 23 axially disposed in the rotational seat 21, a curved snapping member 24 disposed between the snapping hole 23 and the rotational seat 21, and a plurality of ridges 25 formed on an outer surface of the rotational seat 21 adjacent to the first end of the lipstick carrier 20.

A joining device 30 includes an axial well 31 with the first end of the lipstick carrier 20 disposed therein, a plurality of projections 32 equally spaced apart on an outer surface of the joining device 30 at a second end of the joining device 30, the projections 32 being configured to secure to the grooves 12 by snapping, an annular protrusion 33 at a first end of the joining device 30 opposite to the projections 32, an annular member 34 extending out of the protrusion 33, the annular member 34 including two opposite recesses 341, each recess 341 having a recessed element 342 at a first end and a shoulder 343 at a second end, and two internal, opposite latches 35 disposed in the axial well 31 with a gap 351 formed between the latches 35, each latch 35 including a first cavity 352 on an inner surface of an end; a second cavity 353 spaced from a first end of the first cavity 352; a third cavity 354 spaced from a second end of the first cavity 352; each of the first cavity 352, the second cavity 353, and the third cavity 354 having a valley with an angle of 90-degree, an opening of the first cavity 352 being greater than that of the second cavity 353, and an opening of the second cavity 353 being greater than that of the third cavity 354; a protuberance 355 on an outer surface of the end aligned with the first cavity 352, the protuberance 355 having an inclined surface 356 extending downward, the inclined surfaces 356 urging against the snapping member 24; and a plurality of longitudinal projecting elements 36 on an inner surface of the joining device 30 spaced from the latches 35. The projecting elements 36 are configured to secure to the ridges 25 by snapping.

A base 40 includes a central shaft 41 on a bottom; a positioning member 42 being a rectangular cuboid and provided at an end of the shaft 41; four locking elements 43 at four corners of the positioning member 42 respectively, the locking elements 43 being disposed in the second cavities 353 and the third cavities 354 respectively; two opposite first ribs 44 on an inner surface of the base 40 configured to moveably dispose in the recesses 341 respectively; two positioning elements 46 each formed with the first rib 44 and disposed in the recessed element 342; two opposite second ribs 45 on the inner surface of the base 40 configured to urge against an outer surface of the annular member 34; and four depressions 47 adjacent to the first ribs 44 and the second ribs 45 respectively and with the annular protrusion 33 partially received therein.

As shown in FIGS. 2 and 5 to 9 specifically, a removal of a consumed lipstick is discussed in detail below. Firstly, a user may remove the cap 10 out of the joining device 30 to expose a consumed lipstick 50 mounted on the lipstick carrier 20. Secondly, the user may hold the joining device 30 and clockwise rotate the base 40 a predetermined angle. In the embodiment, the base 40 is clockwise rotated 45 degrees so that the first ribs 44 move in the recesses 341 respectively, the positioning elements 46 urge against the shoulders 343 respectively, the positioning member 42 also clockwise rotates 45 degrees, the locking elements 43 move into the gap 351 and the first cavities 352, and the latches 35 are inward flexed to disengage the inclined surfaces 356 from the snapping member 24. The lipstick carrier 20 is unlocked. Finally, the user may lift the lipstick carrier 20 to disengage it from both the joining device 30 and the base 40.

As shown in FIGS. 10 to 14 specifically, an installation of a new lipstick is discussed in detail below. Firstly, another lipstick carrier 20 having a newly mounted lipstick 60 is ready to fasten in the well 31. Secondly, a user may put the snapping hole 23 on the latches 35 and the positioning member 42. Thirdly, the user may counterclockwise rotate the base 40 a predetermined angle. In the embodiment, the base 40 is counterclockwise rotated 45 degrees so that the first ribs 44 move in the recesses 341 respectively, the positioning elements 46 urge against the recessed elements 342 respectively, the positioning member 42 also counterclockwise rotates 45 degrees, the locking elements 43 move into the second cavities 353 and the third cavities 354, and the latches 35 are outward flexed to urge the inclined surfaces 356 against the snapping member 24. The lipstick carrier 20 is locked by the joining device 30. Finally, the user may put the cap 10 onto the joining device 30 to complete the installation of the another lipstick carrier 20. Only the consumed lipstick 50 of the lipstick carrier 20 is replaced rather than discarding the lipstick tube 100. In other words, the lipstick tube 100 of the invention is reusable and environment friendly and does not harm the environment. It is noted that the inclined surfaces 356 urge against the snapping member 24 and when the base 40 is rotated the latches 35 may exert an elastic force to decrease wear of both the joining device 30 and the lipstick carrier 20 to a minimum. As such, the times of replacing the consumed lipstick 50 with a new one in another lipstick carrier 20 can be increased. As a result, a useful life of the lipstick tube can be greatly prolonged.

As shown in FIGS. 2, 6 to 8 and 10 specifically, the locking elements 43 move into the gap 351 and the first cavities 352, and the latches 35 are inward flexed to disengage the inclined surfaces 356 from the snapping member 24 in the unlocking process of the lipstick carrier 20. Further, the snapping member 24 is annular to facilitate an installation of another lipstick carrier 20 in the well 31 without being limited by an angle of the installation.

While the invention has been described in terms of preferred embodiments, those skilled in the art will recognize that the invention can be practiced with modifications within the spirit and scope of the appended claims.

What is claimed is:

1. A lipstick tube, comprising:

a cap comprising an internal space;

a lipstick carrier partially disposed in the space and comprising a rotational seat at a first end distal the cap, a snapping hole axially disposed in the rotational seat, and a curved snapping member disposed between the snapping hole and the rotational seat;

a joining device comprising an axial well with the first end of the lipstick carrier disposed therein, an annular protrusion at a first end, an annular member extending out of the annular protrusion, the annular member including two opposite recesses, each recess having a recessed element at a first end, and two internal, opposite latches disposed in the axial well, each latch including a first cavity on an inner surface of an end, a second cavity spaced from a first end of the first cavity, a third cavity spaced from a second end of the first cavity, and a protuberance on an outer surface of the end of the latch aligned with the first cavity, the protuberance having an inclined surface extending downward, the inclined surfaces urging against the snapping member; and a base comprising a central shaft on a bottom, a positioning member at an end of the shaft, four locking elements at four corners of the positioning member respectively, the locking elements being disposed in the second cavities and the third cavities respectively, two opposite first ribs on an inner surface of the base configured to moveably dispose in the recesses respectively, and two positioning elements each formed with the first rib and disposed in the recessed element.

2. The lipstick tube of claim 1, wherein the cap further comprises a plurality of grooves on an inner surface adjacent to an opening in the cap; and wherein the joining device further comprises a plurality of projections spaced apart on an outer surface at a second end, the projections being configured to secure to the grooves.

3. The lipstick tube of claim 1, wherein the rotational seat comprises a plurality of ridges on an outer surface; and wherein the joining device further comprises a plurality of longitudinal projecting elements on an inner surface, the longitudinal projecting elements being configured to secure to the ridges.

4. The lipstick tube of claim 1, wherein the base further comprises two opposite second ribs formed on the inner surface and configured to urge against an outer surface of the annular member.

5. The lipstick tube of claim 4, wherein the base further comprises a plurality of depressions adjacent to the first and second ribs respectively and with the annular protrusion partially received therein.

6. The lipstick tube of claim 1, wherein each of the recesses include a shoulder at a second end opposite to the recessed element.

7. The lipstick tube of claim 1, wherein the latches are spaced with a gap formed between the latches.

8. The lipstick tube of claim 1, wherein a valley of each of the first cavity, the second cavity, and the third cavity has an angle of 90-degree.

9. The lipstick tube of claim 1, wherein an opening of the first cavity is greater than that of the second cavity, and an opening of the second cavity is greater than that of the third cavity.

10. The lipstick tube of claim 1, wherein the positioning member is a rectangular cuboid.

* * * * *